US010752854B1

(12) United States Patent
Wachtel et al.

(10) Patent No.: US 10,752,854 B1
(45) Date of Patent: Aug. 25, 2020

(54) ADDITIVE FORMULATION AND METHOD OF USING SAME

(71) Applicant: Mazoil Technologies Limited

(72) Inventors: Peter Wachtel, Lancaster, PA (US); Arthur R. Foote, III, Melbourn, FL (US)

(73) Assignee: Mazoil Technologies Limited, Grand Cayman ( * ) Notice: Subject to any disclaimer, the term of this patent is extended or adjusted under 35 U.S.C. 154(b) by 0 days.

(21) Appl. No.: 16/716,650

(22) Filed: Dec. 17, 2019

Related U.S. Application Data

(60) Provisional application No. 62/852,779, filed on May 24, 2019.

(51) Int. Cl.

| | |
|---|---|
| ***C10L 1/23*** | (2006.01) |
| ***C10L 1/16*** | (2006.01) |
| ***C10L 1/182*** | (2006.01) |
| ***C10L 1/238*** | (2006.01) |
| ***C10L 1/19*** | (2006.01) |

(52) U.S. Cl.
CPC ..... *C10L 1/231* (2013.01); *C10L 1/1608* (2013.01); *C10L 1/1616* (2013.01); *C10L 1/1826* (2013.01); *C10L 1/19* (2013.01); *C10L 1/238* (2013.01); *C10L 2270/02* (2013.01)

(58) Field of Classification Search
CPC ..... C10L 1/23; C10L 1/231
See application file for complete search history.

(56) References Cited

U.S. PATENT DOCUMENTS

| | | | | |
|---|---|---|---|---|
| 3,900,297 | A | 8/1975 | Michaels | |
| 4,583,991 | A * | 4/1986 | Germane | C10L 1/231 44/414 |
| 5,288,393 | A | 2/1994 | Jessup | |
| 5,489,316 | A * | 2/1996 | Traverso | C10L 1/003 44/323 |
| 5,593,567 | A | 1/1997 | Jessup | |
| 5,653,866 | A | 8/1997 | Jessup | |
| 5,837,126 | A | 11/1998 | Jessup | |
| 6,030,521 | A | 2/2000 | Jessup | |
| 6,319,294 | B1 | 11/2001 | Foote | |

(Continued)

FOREIGN PATENT DOCUMENTS

| | | |
|---|---|---|
| AU | 2006228038 | 11/2006 |
| CN | 1821370 | 8/2006 |

OTHER PUBLICATIONS

Yan, Y. et al. "Study on the effect of MAZ combustion additive on gasoline engine performance emission" Journal Society Automotive Engineers of Japan. Oct. 2017, p. 655-659.

(Continued)

*Primary Examiner* — Ellen M McAvoy
(74) *Attorney, Agent, or Firm* — Quarles & Brady LLP

(57) ABSTRACT

A fuel additive formulation, method of use, and method of producing the fuel additive formulation are described. The fuel additive of the present disclosure comprises a mixture of nitroparaffins comprising nitropropane and nitromethane, a lubricant, and an aromatic hydrocarbon. The fuel additive formulation is substantially free of nitroethane. The combustion in an internal combustion engine of a fuel containing the additive results in reduced emissions relative to the combustion of a fuel not containing the additive.

7 Claims, 11 Drawing Sheets

Test bench system diagram

(56) References Cited

U.S. PATENT DOCUMENTS

| | | | | |
|---|---|---|---|---|
| 7,491,249 | B2 | 2/2009 | Foote | |
| 2015/0089862 | A1 * | 4/2015 | Gaffney | C10L 1/026<br>44/414 |

OTHER PUBLICATIONS

Anonymous. "For Chemists—Home Made Fuel Additive. Ferrarichat", Dec. 18, 2008, XP055676067, Retrieved form the Internet: url:https://www.ferrarichat.com/forum/threads/for-chemists-home-made-fuel-additive.223140/.

International Searching Authority, International Search Report and Written Opinion for application PCT/US2019/066708, dated Mar. 23, 2020.

* cited by examiner

Test bench system diagram

| Item | China-V Limitations | Benchmark Diesel | Benchmark Diesel +MAZ | Varying Ratio |
|---|---|---|---|---|
| PM | 0.020 g/kWh | 0.0096 g/kWh | 0.0082 g/kWh | -14.58% |

| Operating Condition | 1 | 2 | 3 | 4 | 5 | 6 | 7 | 8 | 9 | 10 | 11 | 12 | 13 |
|---|---|---|---|---|---|---|---|---|---|---|---|---|---|
| Benchmark Diesel | 0.0026 | 0.007 | 0.0037 | 0.0023 | 0.005 | 0.005 | 0.003 | 0.0038 | 0.0052 | 0.0046 | 0.0068 | 0.0031 | 0.004 |
| Benchmark Diesel +MAZ | 0.0011 | 0.0048 | 0.0022 | 0.0009 | 0.0047 | 0.0053 | 0.0028 | 0.0029 | 0.0044 | 0.004 | 0.0059 | 0.0023 | 0.0026 |
| Varing Rate | -57.69 | -31.43 | -40.54 | [illegible] | -21.67 | -11.67 | -5.67 | -23.68 | -15.38 | -13.04 | -13.24 | 9.45 | -35.00 |

| Item | ESC cycle | | |
|---|---|---|---|
| | MAZ_0 | MAZ_1000 | Decreasing amplitude |
| $NO_x$ (g/kWh) | 1.0475 | 1.0232 | 2.32% |
| $CO_2$ (g/kWh) | 662.36 | 657.92 | 0.67% |
| CO (g/kWh) | 0.3473 | 0.3395 | 2.25% |
| HC (g/kWh) | 0.0061 | 0 | 100% |

FIG. 6

| Item | China-V Limitations | Benchmark Diesel | Benchmark Diesel +MAZ | Varying Ratio |
|---|---|---|---|---|
| PM | 0.003 g/kWh | 0.0161 g/kWh | 0.0152 g/kWh | -5.59% |

$$E_{point} = E/P \qquad E_{spec} = \sum (E \cdot P) / \sum P$$

| $E_{spec}$ | $CO_2$ %/kw | CO ppm/kw | THC ppm/kw | NOx ppm/kw |
|---|---|---|---|---|
| MAZ_0 | 6.88 | 68.4 | 4.11 | 918 |
| MAZ_1000 | 6.78 | 66.4 | 3.83 | 906 |
| Decreasing amplitude% | 1.42 | 2.87 | 6.82 | 1.27 |

FIG. 9

ADDITIVE FORMULATION AND METHOD OF USING SAME

RELATED APPLICATIONS

This application claims priority from U.S. provisional patent application No. 62/852,779, filed May 24, 2019, which is hereby incorporated herein by reference in its entirety for all purposes.

FIELD OF THE DISCLOSURE

The present disclosure relates to an improved fuel additive formulation for internal combustion engines, and method of using the same. The fuel additive of the present disclosure provides an improved motor fuel. The formulation of the present disclosure is useful in either gasoline- or diesel-fueled engines, and in automobiles, trucks, and various other engine applications. In a preferred embodiment, the disclosure is an additive formulation, and method of using the formulation, to reduce emissions, improve performance and environmental health and safety, and reduce the risks of toxic substances associated with motor fuels.

BACKGROUND OF THE DISCLOSURE

For some time, others have worked to improve the performance and reduce the adverse environmental effects of internal combustion engines. As the increased use of automobiles and trucks in the United States has offset reductions in auto emissions, legislators, regulators, the petroleum and automobile industries, and various other groups have sought new ways to address air pollution from cars and trucks. As part of that effort, these groups have increasingly focused on modification of fuels and fuel additives. Perhaps the best known fuel modification relating to air pollution control is the elimination of lead, used as an antiknock compound, from gasoline.

The 1990 amendments to the Clean Air Act contain a new fuels program, including a reformulated gasoline program to reduce emissions of toxic air pollutants and emissions that cause summer ozone pollution, and an oxygenated gasoline program to reduce carbon monoxide emissions in areas where carbon monoxide is a problem in winter. Environmental agencies, such as the United States Environmental Protection Agency (EPA) and the California Air Resources Board (CARB), have promulgated various regulations compelling many fuel modification efforts.

With respect to the oxygenated gasoline program, the most commonly used oxygenates are ethanol, made from biomass (usually grain or corn in the United States), and methyl tertiary butyl ether (MTBE), made from methanol that is usually made from natural gas. Oxygenates such as ethanol and MTBE increase a fuel's octane rating, a measure of its tendency to resist engine knock. In addition, MTBE mixes well with gasoline and is easily transported through the existing gasoline pipeline distribution network.

Both ethanol (as well as other alcohol-based fuels) and MTBE have significant drawbacks. Ethanol-based fuel formulations have failed to deliver the desired combination of increased performance, reduced emissions, and environmental safety. They do not perform substantially better than straight-run gasoline, and also increase the cost of the fuel.

Adding either ethanol or MTBE to gasoline dilutes the energy content of the fuel. Ethanol has a lower energy content than MTBE, which in turn has a lower energy content than straight-run gasoline. Ethanol has only about 67% the energy content of the same volume of gasoline and it has only about 81% of the energy content of an equivalent volume of MTBE. Thus, more fuel is required to travel the same distance, resulting in higher fuel costs and lower fuel economy. In addition, the volatility of the gasoline that is added to an ethanol/gasoline blend must be further reduced in order to offset the increased volatility of the alcohol in the blend.

Ethanol also has a much greater affinity for water than do petroleum products. It cannot be shipped in petroleum pipelines, which invariably contain residual amounts of water. Instead, ethanol is typically transported by truck, or manufactured where gasoline is made. Ethanol is also corrosive. In addition, at higher concentrations, the engine must be modified to use an ethanol blend.

Ethanol has other drawbacks as well. Ethanol has a high vapor pressure relative to straight-run gasoline. Its high vapor pressure increases fuel evaporation at temperatures above 130° Fahrenheit, which leads to increases in volatile organic compound (VOC) emissions.

Finally, although much research has focused on the health effects of ethanol as a beverage, little research has addressed ethanol use as a fuel additive. Nor has ethanol been evaluated fully from the standpoint of its environmental fate and exposure potential.

MTBE has its share of drawbacks as well. MTBE was first added to gasoline to boost the octane rating. In line with the 1990 Clean Air Act amendments, MTBE was added in even larger amounts as an oxygenate to reduce air pollution. Unfortunately, MTBE is now showing up as a contaminant in groundwater throughout the United States as a result of releases (i.e., leaking underground gasoline storage tanks, accidental spillage, leakage in transport, automobile accidents resulting in fuel releases, etc.).

MTBE is particularly problematic as a groundwater contaminant because it is soluble in water. It is highly mobile, does not cling to soil particles, and does not decay readily. MTBE has been used as an octane enhancer for about twenty years. The environmental and health risks posed by MTBE, therefore, parallel those of gasoline. Some sources estimate that 65% of all leaking underground fuel storage tank sites involve releases of MTBE. It is estimated that MTBE may be contaminating as many as 9,000 community water supplies in 31 states. A University of California study showed that MTBE has affected at least 10,000 groundwater sites in the State of California alone.

The EPA also has determined that MTBE is carcinogenic, at least when inhaled. Other unwelcome environmental characteristics are its foul smell and taste, even at very low concentrations (parts per billion). The environmental threat from MTBE may be even greater than that from an equivalent volume of straight-run gasoline. The constituents of gasoline considered most dangerous are the aromatic hydrocarbons: benzene, toluene, ethylbenzene, and xylene (collectively, BTEX). The BTEX aromatic hydrocarbons have the lowest acceptable drinking water contamination limits. Both ethanol and MTBE enhance the environmental risks posed by the BTEX compounds, apart from their own toxicity. Ethanol and MTBE act as a co-solvent for BTEX compounds in gasoline. As a result, the BTEX plume from a source of gasoline contamination containing ethanol and/or MTBE travels farther and faster than one that does not contain either oxygenate.

The BTEX aromatic compounds have relatively lower solubility in water than MTBE. BTEX compounds tend to biodegrade in situ when they leak into the soil and ground water. This provides at least some natural attenuation. Relative to the BTEX compounds, however, MTBE biodegrades at a significantly lower rate, by at least one order of magnitude, or ten times more slowly. Some sources estimate that the time required for MTBE to degrade to less than a few percent of the original contaminant level is about ten years.

Other initiatives have involved efforts to formulate a cleaner burning-reformulated-gasoline (RFG). For example, Union Oil Company of California (UNOCAL) has secured a number of U.S. patents that cover various formulations of RFG, including Jessup, et al., U.S. Pat. No. 5,288,393, for Gasoline Fuel (Feb. 22, 1994); Jessup, et al., U.S. Pat. No. 5,593,567, for Gasoline Fuel (Jan. 14, 1997); Jessup, et al., U.S. Pat. No. 5,653,866, for Gasoline Fuel (Aug. 5, 1997); Jessup, et al., U.S. Pat. No. 5,837,126 for Gasoline Fuel, (Nov. 17, 1998); Jessup, et al., U.S. Pat. No. 6,030,521 for Gasoline Fuel (Feb. 29, 2000). The UNOCAL patents specify various end points in the blending of gasoline, and purport to reduce emissions of selected contaminants: Carbon monoxide (CO); Nitric oxides (NOx); Unburned Hydrocarbons (HC); as well as other emissions.

These various problems have impaired the efficacy or cost-effectiveness of each of these various alternatives. Alcohols have not resolved the performance and emission needs for improved motor fuels. MTBE imposes unacceptable environmental (soil and groundwater) and public health problems. Reformulated gasoline has been controversial and expensive. Accordingly, there remains a substantial and unmet need for an improved gasoline formulation that enhances (or at least does not impair) performance, while reducing emissions and the environmental and public health risks from motor fuels. The fuel additive according to an embodiment of the present disclosure satisfies those needs.

Applicant previously discovered a fuel additive that was the subject of U.S. Pat. Nos. 6,319,294 and 7,491,249, herein incorporated in their entirety. This formulation, known as "MAZ," is shown in the table below.

TABLE 1

"MAZ" Formulation

| Component | Weight Percent (Wt. %) |
|---|---|
| 1-Nitropropane | 40-60% |
| Nitroethane | 10-30% |
| Nitromethane | 10-30% |
| Toluene | 2-8% |
| Lubricant | 0.5-3% |

Nitroparaffins have been used in prior fuel formulations, for different engine applications, without achieving the results of the present disclosure. For example, nitroparaffins have long been used as fuels and/or fuel additives in model engines, turbine engines, and other specialized engines. Nitromethane and nitroethane have been used by hobbyists. Nitroparaffins have also been used extensively in drag racing, and other racing applications, due to their extremely high energy content.

The use of nitroparaffins in motor fuels for automobiles and trucks, however, has several distinct disadvantages. First, some nitroparaffins are explosive and pose substantial hazards. Second, nitroparaffins are significantly more expensive than gasoline—so expensive as to preclude their use in automotive and truck applications. Third, nitroparaffins have generally been used in specialized engines that are very different than gas and diesel engines. Fourth, the high energy content of nitroparaffins requires modification of the engine, and additional care in transport, storage, and handling of both the nitroparaffin and the fuel containing the additive. Further, in some fuel applications, nitroparaffins have had a tendency to gel. The high cost, and extremely high energy content of nitroparaffins, has precluded their use as an automotive and/or truck fuel. Moreover, the extreme volatility and danger of explosion from nitromethane taught away from its use as a motor fuel for automobiles and/or trucks.

Advantages of the Disclosure

It is an advantage of the present disclosure to provide a motor fuel additive that provides improved performance at additive concentrations typical of known additives, and reduced emissions at lower concentrations, while avoiding many of the problems associated with prior known additives and motor fuels.

Another advantage of the present disclosure is to provide a motor fuel that exhibits improved performance relative to prior known motor fuels, while avoiding many of the problems associated with prior known motor fuels.

A further advantage of the present disclosure is to provide a motor fuel that reduces emissions relative to prior known motor fuels, while avoiding many of the problems associated with prior known motor fuels.

Yet another advantage of the present disclosure is to provide a replacement for oxygenates, such as ethanol and MTBE.

Another advantage of the present disclosure is to provide a replacement for oxygenates, such as ethanol and MTBE that reduces emissions.

An additional advantage of the present disclosure is to provide an improved fuel formulation that reduces total hydrocarbon emissions.

Yet another advantage of the present disclosure is to provide an improved formulation that reduces non-methane hydrocarbon emissions.

Another advantage of the present disclosure is to provide an improved fuel formulation that reduces carbon monoxide emissions.

A further advantage of the present disclosure is to provide an improved fuel formulation that reduces NOx formation.

An additional advantage of the present disclosure is to provide an improved fuel formulation that reduces volatile organic compounds (VOCs).

Additional advantages and advantages of the disclosure are set forth, in part, in the description which follows and, in part, will be obvious from the description or may be learned by practice of the disclosure. The advantages and advantages of the disclosure will be realized in detail by means of the instrumentalities and combinations particularly pointed out in the appended claims.

BRIEF DESCRIPTION OF THE DRAWINGS

FIG. 6 illustrates the emission characteristics, ESC cycle, other pollutants emission.

FIG. 9 illustrates the emission characteristics, ETC cycle, other pollutants emission.

BRIEF SUMMARY OF THE DISCLOSURE

Figure 1:
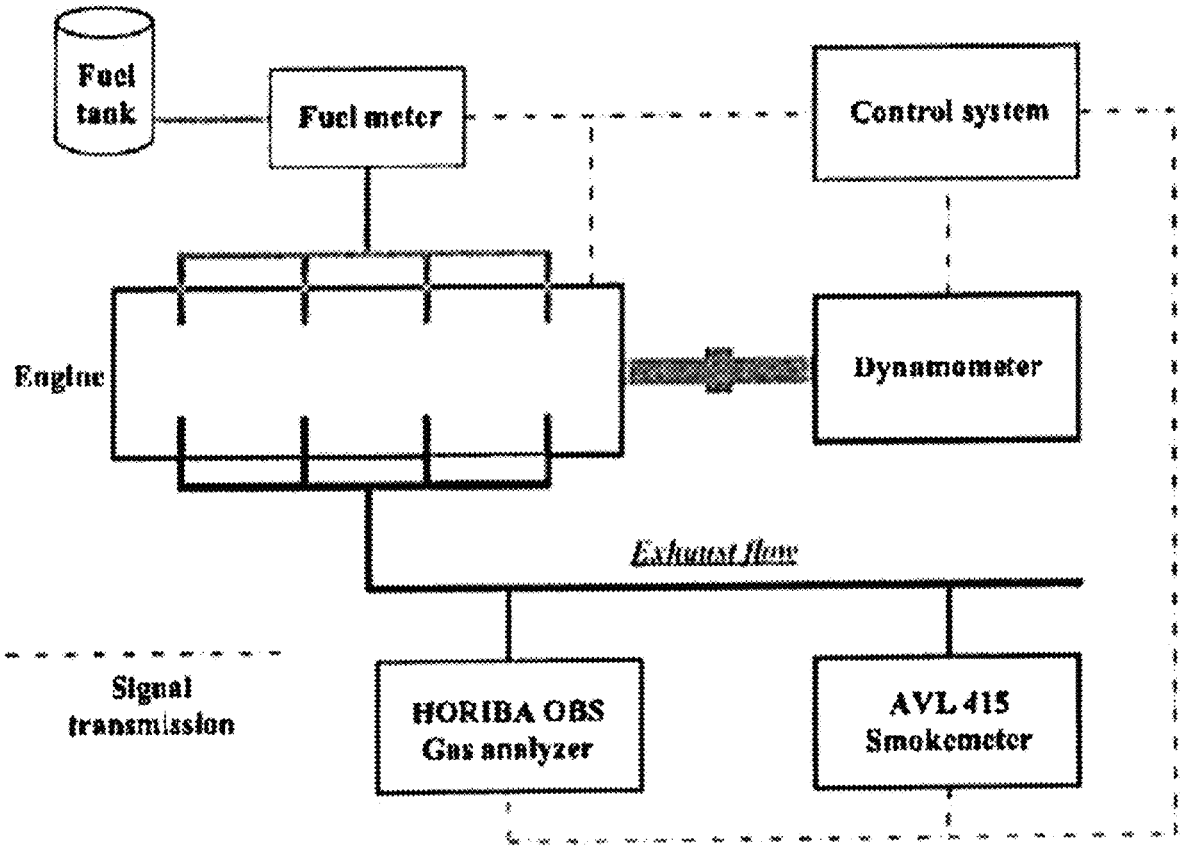
FIG. 1 is a diagram of an embodiment of a test bench system.

The present disclosure comprises an improved fuel additive formulation and method of using the same. As embodied herein, the present disclosure comprises an additive formulation for fuels, and a fuel containing the additive, comprising nitroparaffin, a lubricant, and an aromatic hydrocarbon. The fuel containing the additive resulting in reduced emissions relative to a fuel not containing the additive when burned in, by way of example only, a boiler, a turbine, or an internal combustion engine.

An embodiment comprises an additive formulation for a fuel comprising nitroparaffin, a lubricant, an aromatic hydrocarbon, wherein combustion in an internal combustion engine of a fuel containing the additive results in reduced emissions relative to the combustion of a fuel not containing the additive.

In an embodiment the nitroparaffin comprises at least one nitroparaffin selected from the group consisting of nitropropane and nitromethane, and any combination thereof. In an embodiment the formulation is substantially free of nitroethane. In an embodiment the nitroparaffin comprises about 40 to about 65 weight percent nitropropane and about 10 to about 30 weight percent nitromethane.

An embodiment comprises from about 0.5 to about 5 weight percent lubricant. In an embodiment the lubricant comprises an ester. In an embodiment the lubricant comprises a polyester. In an embodiment the lubricant comprises $C_5$-$C_{10}$ fatty acids. In an embodiment the lubricant comprises $C_5$-$C_{10}$ fatty acid esters. In an embodiment the lubricant comprises $C_5$-$C_{10}$ fatty acid esters comprising at least one of pentaerythritol and dipentaerythritol. In an embodiment the lubricant is a $C_5$-$C_{10}$ fatty acid ester with pentaerythritol. In an embodiment the lubricant is a $C_5$-$C_{10}$ fatty acid ester with dipentaerythritol. In an embodiment the lubricant is a $C_5$-$C_{10}$ fatty acid ester with pentaerythritol and dipentaerythritol. In an embodiment the lubricant comprises from about 75 to about 80 wt. % $C_5$-$C_{10}$ fatty acid esters with pentaerythritol, preferably from about 76 to about 79 wt. %, and more preferably from about 77 to about 78 wt. % $C_5$-$C_{10}$ fatty acid esters with pentaerythritol. In an embodiment the lubricant comprises from about 19 to about 24 wt. % $C_5$-$C_{10}$ fatty acid esters with dipentaerythritol, preferably from about 20 to about 23 wt. %, and more preferably from about 21 to about 22 wt. % $C_5$-$C_{10}$ fatty acid esters with dipentaerythritol. In an embodiment the lubricant comprises $C_5$-$C_{10}$ fatty acid esters with pentaerythritol and $C_5$-$C_{10}$ fatty acid esters with dipentaerythritol. In an embodiment the ratio of $C_5$-$C_{10}$ fatty acid esters with pentaerythritol to $C_5$-$C_{10}$ fatty acid esters with dipentaerythritol is about 1:2.5 to about 1:4.5, preferably about 1:3.0 to about 1.40, and more preferably about 1:3.5 to about 1.3.7.

An embodiment comprises from about 10 to about 40 wt. % aromatic hydrocarbon. In an embodiment the aromatic hydrocarbon is selected from the group consisting of, ethyl benzene, xylene, and toluene. In an embodiment the aromatic hydrocarbon is toluene.

In an embodiment the reduced emissions are comprised of at least one of total hydrocarbons (THC), non-methane hydrocarbons, carbon monoxide (CO), and nitrous oxide (NOx). In an embodiment combustion in an internal combustion engine of a fuel containing the additive results in a reduction in particulate matter (PM) emissions relative to the combustion of a fuel not containing the additive.

In an embodiment combustion in an internal combustion engine of a fuel containing the additive results in enhanced engine performance relative to the combustion of a fuel not containing the additive.

In another embodiment, the present disclosure comprises an additive formulation for fuels, or a fuel containing the additive, comprising: a first component, comprising 50-95 weight percent total of nitropropane and nitromethane; a second component, comprising an aromatic hydrocarbon, and a third component comprising a lubricant; the additive formulation reducing emissions of one or more of the emissions selected from the group comprising total hydrocarbons, non-methane hydrocarbons, carbon monoxide, and $NO_x$ when burned in an internal combustion engine. The aromatic hydrocarbon may include, but is not limited to, an aliphatic derivative of, benzene, xylene, or toluene. The additive formulation is substantially free of nitroethane.

In a further embodiment, the present disclosure comprises: an additive formulation for motor fuels, and a fuel containing the additive, comprising: from about 40 to about 65 weight percent nitropropane; from about 10 to about 30 weight percent nitromethane; from about 10 to about 40 weight percent aromatic hydrocarbon; and from about 0.5 to about 5 weight percent lubricant, wherein the additive is substantially free of nitroethane. In a further embodiment, the present disclosure comprises an additive formulation for a fuel comprising about 40 to about 65 weight percent nitropropane, about 10 to about 30 weight percent nitromethane, about 0.5 to about 5 weight percent $C_5$-$C_{10}$ fatty acid ester, about 10 to about 40 weight percent aromatic hydrocarbon, and wherein the additive is substantially free of nitroethane. In a further embodiment the present disclosure comprises an additive formulation for a fuel comprising about 40 to about 65 weight percent nitropropane, about 10 to about 30 weight percent nitromethane, about 0.5 to about 5 weight percent $C_5$-$C_{10}$ fatty acid ester having at least one of pentaerythritol and dipentaerythritol, about 10 to about 40 weight percent toluene, and wherein the additive is substantially free of nitroethane. In an embodiment combustion in an internal combustion engine of a fuel containing the additive results in at least one of reduced emissions, including particulate matter emissions, and enhanced engine performance, relative to the combustion of a fuel not containing the additive. Another embodiment of the present disclosure is a fuel comprising the additive.

The disclosure further comprises the use of the additive and fuel products as a fuel.

The fuel may be used in any kind of power unit, including, but not limited to, a boiler, a turbine, internal combustion engine, or any other type of appropriate application.

Both the foregoing general description and the following detailed description are exemplary and explanatory only, and are not restrictive of the disclosure as claimed. The accompanying drawings, which are incorporated herein by reference, and constitute a part of the specification, illustrate certain embodiments of the disclosure and, together with the detailed description, serve to explain the principles of the present disclosure.

DETAILED DESCRIPTION OF THE PREFERRED EMBODIMENTS

For the purposes of this disclosure, the terms "F MAZ" and "MAZ Nitro" are used interchangeably. Maz and F Maz formulations are represented in Tables 1 and 2, respectfully. Maz 600 is a 60:40 ratio of Maz:di-tert-butyl peroxide (DTBP) by weight. F Maz 600 is a 60:40 ratio of F Maz:DTBP by weight. F Maz/X 70/30 is a 70:30 ratio of F Maz/X:2,4 dinitrotoluene by weight. F Maz/X 60/40 is a 60:40 ratio of F Maz/X: 2,4 dinitrotoluene by weight. F Maz/Y 60/40 is a 60:40 ratio of F Maz/Y:azobisisobutyronitrile by weight. "X" refers to the addition of 2,4-dinitrotoluene to the formula and "Y" refers to the addition of azobisisobutyronitrile to the formula. The DTPB used is a 98% solution. All amounts are by wt. %.

As illustrated by the data in the accompanying tables and graphs, and disclosed in the accompanying claims, the present disclosure is a fuel additive for motor fuels for internal combustion engines, comprising nitroparaffin substantially free of nitroethane, a lubricant, and an aromatic hydrocarbon. The disclosure comprises an improved fuel additive formulation, and method of using the formulation.

The present disclosure employs a unique combination of nitroparaffins, lubricants, and aromatic hydrocarbons to enhance the performance of and reduce emissions from internal combustion engines including, in particular, automobiles and trucks.

Applicant has invented a novel and non-obvious formulation, and method of using the same. The additive according to an embodiment of the present disclosure differs in significant respects from the prior known formulations, as well as from alcohol-based (ethanol) and MTBE fuel additives, and performs better than prior known formulations. One embodiment of the present disclosure is disclosed in Table 2:

TABLE 2

"F MAZ" formulation.

| Component | Weight Percent (Wt. %) |
|---|---|
| Nitropropane | 40-65% |
| Nitroethane | 0% |
| Nitromethane | 10-30% |
| Toluene | 10-40% |
| Lubricant | 0.5-5% |

Applicants have made a number of specific and non-obvious modifications in the formulation according to an embodiment of the present disclosure. Applicant believes that these modifications produce the improvements observed.

Unlike the prior known formulations, which employed commercially available ester oils, Applicant has developed a novel and non-obvious formula comprising a lubricant for use in the additive according to an embodiment of the present disclosure.

Applicant preferably lowers the concentration of nitroethane to a substantially untraceable amount. Nitroethane is also a known neurotoxin. Nitroethane causes dermatitis and is a known substance in clandestine laboratories for synthesis of controlled substances. Reduction of nitroethane reduces toxicity of the additive and reduces emissions.

The present disclosure is preferably employed at a lower overall concentration in the fuel relative to prior known formulations. This too lowers emissions and reduces toxicity, while increasing performance.

Applicant believes that these modifications provide improved performance of the additive in terms of increased performance and reduced emissions, using lower concentrations of additive. It also makes the product safer to handle.

The additive according to an embodiment of the present disclosure improves performance, reduces material handling requirements, and lowers environmental and public health and safety risks, as well as emissions, at concentrations at which prior formulations were either untested, ineffective, or failed to produce the unique combination of benefits of the presently disclosed formulation.

It has not been reliably established that the prior known formulations provided any improvement in performance or emissions. The additive according to an embodiment of the present disclosure, on the other hand, achieves benefits, at low concentrations of additive. Thus, the additive according to an embodiment of the present disclosure meets the long-felt, yet unresolved, need for a more environmentally safe, improved fuel additive. None of the prior known formulations suggest the additive according to an embodiment of the present disclosure.

Applicant has developed a new method of creating a stable mixture of nitroparaffins in gasoline and/or diesel fuel, namely by introduction of a lubricant, such as but not limited to, a polyester, and an aromatic hydrocarbon. Applicant has discovered that low concentrations of additive according to an embodiment of the present disclosure reduce emissions and increase performance. Toxicity has been reduced by reducing the concentration of additive in the fuel, while reducing emissions.

As used herein, the term "nitroparaffin" refers to any of a class of aliphatic organic compounds containing a nitro functional group. A skilled person in the art understands that the term "aliphatic" refers to a class of organic compounds in which the carbon atoms are arranged in an open chain. Further, "an aromatic hydrocarbon, aryl hydrocarbon," is used herein as a class of cyclic, planar compounds that resemble benzene in electronic configuration and chemical behavior, and are generally derived from petroleum. Examples of petroleum derived aromatic hydrocarbons include benzene, toluene, ethylbenzene, and o-, m-, and p-xylene isomers, collectively named BTEX. Other examples of aromatic hydrocarbons include polycyclic aromatic hydrocarbons (PAHs) such as naphthalene, phenanthrene, fluorene, chrysene, and the like.

Emission reductions are achieved by the removal, introduction, modification, or reduction of various components. For example, nitroethane is absent from the current formulation; a lubricant, including, but not limited to, a polyester, and an aromatic hydrocarbon have been substituted for nitroethane; the concentration of lubricant, and nitromethane have been reduced relative to certain prior known formulations; nitroethane is substantially omitted from the formulation; and/or the overall concentration of additive in the fuel has been reduced to a level lower than that typically used, disclosed, taught, or suggested in prior known disclosures. Applicant has found that careful balancing of the formulation between the various components is necessary to make the product more safely, while maintaining superior emission reduction capacity. Applicant has developed a number of improvements that they believe contribute to the beneficial effect of the disclosure on emissions and performance.

Applicant, however, in contrast to each of the prior known formulations, has employed at least one lubricant not known for use in fuel additives, producing unexpected, beneficial properties. In conjunction with the other features of the present disclosure, Applicant has discovered that the performance and ability to lower emissions was improved by the additive according to the present disclosure to an unexpected degree.

Persons of ordinary skill in the art would not have expected the benefits of the present disclosure, at the time the disclosure was made. Whereas others focused on increasing horsepower and fuel efficiency.

First, Applicant has preferably reduced the ratio of lubricant to nitroparaffin. This, in turn, reduces emissions from combustion of the lubricant. The ratio of lubricant to nitroparaffin has been reduced to levels well below the levels employed in many prior known formulations. U.S. Pat. No. 3,900,297 to Michaels teaches the use of ester oil at levels of 10 to 90% of the additive formulation, in contrast to the preferred range of lubricant of less than about 5% and more preferably less than about 2%, according to embodiments of the present disclosure. Michaels taught that higher concentrations of ester oil lubricant were necessary to provide upper cylinder lubrication and to make a homogenous fuel. Michaels recommends a maximum concentration of 25% ester oil to prevent potential engine fouling. Applicant has produced beneficial effects at concentrations of lubricants far below the lower limits of Michaels' range.

Second, an aromatic hydrocarbon, including but not limited to, toluene, has been added to enhance engine combustion and improve emissions. Toluene is a component of fuels. Toluene emulsifies and/or improves the solubility of the nitroparaffins in fuels, reducing the amount of the lubricant required. In the process, it allows for the proper emulsion of the nitroparaffins into the additive and, ultimately, the fuel. Applicant has found that toluene enhances and augments the effect of the lubricant in the present disclosure to enhance the solubility of nitroparaffins in fuels.

Third, Applicant does not add nitroethane to the formulation. Nitroethane is highly toxic as well as dangerous. It presents a substantial hazard of explosion and danger to personal safety. Substantially omitting nitroethane reduces the risk and lowers the toxicity of the additive and, in turn, of the fuel in which it is used.

Applicant has made several modifications to the formulation of the present disclosure to reduce the health risks posed by the toxic components of the formulation. Applicant has also modified the formulation to reduce emission from engines using the additive according to an embodiment of the present disclosure. The lower concentration of additive package in the fuels of the present disclosure achieves these advantages. The higher concentration employed in prior known formulations and disclosed in the related art would result in higher emission of NOx, uncombusted nitroparaffins, and total hydrocarbons and non-methane hydrocarbons. They would also tend to increase ozone formation. This would result from both the higher concentrations of lubricant and higher concentrations of nitroparaffins, typically found in the prior known formulations. At the relatively high concentrations of ester oils and nitromethane disclosed in prior known formulations, the fuel would be substantially more toxic and pose greater risks to ground water. Emissions would be increased in general, specifically of toxic materials.

The present disclosure comprises one or more nitroparaffins, substantially free of nitroethane. As in an embodiment, the nitroparaffins of the present disclosure are selected from the group consisting of at least one of nitromethane and nitropropane. Each may be present in combination with the other. For example, each of nitromethane and nitropropane may comprise from 1% to 100% of the nitroparaffin component of the disclosure. In a preferred embodiment of the present disclosure, nitromethane is the preferred nitroparaffin.

The relative amounts of the various nitroparaffins are adjusted to complement one another, as are the relative amounts of toluene and lubricant. The relative amount of nitroparaffin, on one hand, and lubricant and toluene on the other, are also adjusted to complement one another. The proportions of the components of the present disclosure are below the ranges of those components in prior known formulations.

As embodied herein, the present disclosure comprises an additive formulation for fuels, and a fuel containing the additive, comprising nitroparaffin, a lubricant, and an aromatic hydrocarbon. The fuel containing the additive resulting in reduced emissions relative to a fuel not containing the additive when burned in, by way of example only, a boiler, a turbine, or an internal combustion engine.

An embodiment comprises an additive formulation for a fuel comprising nitroparaffin, a lubricant, an aromatic hydrocarbon, wherein combustion in an internal combustion engine of a fuel containing the additive results in reduced emissions relative to the combustion of a fuel not containing the additive.

In an embodiment the nitroparaffin comprises at least one nitroparaffin selected from the group consisting of nitropropane and nitromethane, and any combination thereof. In an embodiment the formulation is substantially free of nitroethane. In an embodiment the nitroparaffin comprises about 40 to about 65 weight percent nitropropane and about 10 to about 30 weight percent nitromethane.

In an embodiment, nitromethane is present as 0% to 25% of the nitroparaffin fraction of the additive. Preferably, nitromethane is present as 15% to 25% of the nitroparaffin fraction of the additive, and more preferably, as 20% of the additive formulation. In an embodiment nitropropane is present as 40% to 65% of the nitroparaffin fraction of the additive.

An embodiment comprises from about 0.5 to about 5 weight percent lubricant. In an embodiment the lubricant comprises an ester. In an embodiment the lubricant comprises a polyester. In an embodiment the lubricant comprises $C_5$-$C_{10}$ fatty acids. In an embodiment the lubricant comprises $C_5$-$C_{10}$ fatty acid esters. In an embodiment the lubricant comprises $C_5$-$C_{10}$ fatty acid esters comprising at least one of $C_5$-$C_{10}$ fatty acid esters with pentaerythritol (identified by, and available commercially under, CAS #68424-31-7) and $C_5$-$C_{10}$ fatty acid esters with dipentaerythritol (identified by, and available commercially under, CAS #70983-72-1). In an embodiment the lubricant is a $C_5$-$C_{10}$ fatty acid ester with pentaerythritol. In an embodiment the lubricant is a $C_5$-$C_{10}$ fatty acid ester with dipentaerythritol. In an embodiment the lubricant is a $C_5$-$C_{10}$ fatty acid ester with pentaerythritol and dipentaerythritol. In an embodiment the lubricant comprises from about 75 to about 80 wt. % $C_5$-$C_{10}$ fatty acid esters with pentaerythritol, preferably from about 76 to about 79 wt. %, and more preferably from about 77 to about 78 wt. % $C_5$-$C_{10}$ fatty acid esters with pentaerythritol. In an embodiment the lubricant comprises from about 19 to about 24 wt. % $C_5$-$C_{10}$ fatty acid esters with dipentaerythritol, preferably from about 20 to about 23 wt. %, and more preferably from about 21 to about 22 wt. % $C_5$-$C_{10}$ fatty acid esters with dipentaerythritol. In an embodiment the lubricant comprises $C_5$-$C_{10}$ fatty acid esters with pentaerythritol and $C_5$-$C_{10}$ fatty acid esters with dipentaerythritol. In an embodiment the ratio of $C_5$-$C_{10}$ fatty acid esters with pentaerythritol to $C_5$-$C_{10}$ fatty acid esters with dipentaerythritol is about 1:2.5 to about 1:4.5, preferably about 1:3.0 to about 1.40, and more preferably about 1:3.5 to about 1:3.7.

An embodiment comprises from about 10 to about 40 wt. % aromatic hydrocarbon. In an embodiment the aromatic hydrocarbon is selected from the group consisting of, ethyl benzene, xylene, and toluene. In an embodiment the aromatic hydrocarbon is toluene.

In an embodiment the reduced emissions are comprised of at least one of total hydrocarbons (THC), non-methane hydrocarbons, carbon monoxide (CO), and nitrous oxide (NOx). In an embodiment combustion in an internal combustion engine of a fuel containing the additive results in a reduction in particulate matter (PM) emissions relative to the combustion of a fuel not containing the additive.

In an embodiment combustion in an internal combustion engine of a fuel containing the additive results in enhanced engine performance relative to the combustion of a fuel not containing the additive.

In another embodiment, the present disclosure comprises an additive formulation for fuels, or a fuel containing the additive, comprising: a first component, comprising 50-95 weight percent total of nitropropane and nitromethane; a second component, comprising an aromatic hydrocarbon, and a third component comprising a lubricant; the additive formulation reducing emissions of one or more of the emissions selected from the group comprising total hydrocarbons, non-methane hydrocarbons, carbon monoxide, and $NO_x$ when burned in an internal combustion engine. The aromatic hydrocarbon may include, but is not limited to, an aliphatic derivative of, benzene, xylene, or toluene. The additive formulation is substantially free of nitroethane.

In a further embodiment, the present disclosure comprises: an additive formulation for motor fuels, and a fuel containing the additive, comprising: from about 40 to about 65 weight percent nitropropane; from about 10 to about 30 weight percent nitromethane; from about 10 to about 40 weight percent aromatic hydrocarbon; and from about 0.5 to about 5 weight percent lubricant, wherein the additive is substantially free of nitroethane. In a further embodiment, the present disclosure comprises an additive formulation for a fuel comprising about 40 to about 65 weight percent nitropropane, about 10 to about 30 weight percent nitromethane, about 0.5 to about 5 weight percent $C_5$-$C_{10}$ fatty acid ester, about 10 to about 40 weight percent aromatic hydrocarbon, and wherein the additive is substantially free of nitroethane. In a further embodiment the present disclosure comprises an additive formulation for a fuel comprising about 40 to about 65 weight percent nitropropane, about 10 to about 30 weight percent nitromethane, about 0.5 to about 5 weight percent $C_5$-$C_{10}$ fatty acid ester having at least one of pentaerythritol and dipentaerythritol, about 10 to about 40 weight percent toluene, and wherein the additive is substantially free of nitroethane. In an embodiment combustion in an internal combustion engine of a fuel containing the additive results in at least one of reduced emissions, including particulate matter emissions, and enhanced engine performance, relative to the combustion of a fuel not containing the additive. Another embodiment of the present disclosure is a fuel comprising the additive.

The disclosure further comprises the use of the additive and fuel products as a fuel. An embodiment according to the present disclosure achieves improved performance, as well as reduced emissions at lower concentrations of additive than prior known formulations.

The amount of additive used per gallon of fuel in an embodiment according to the present disclosure is typically used in amounts less than about 20%. More specifically, the amount of additive is generally less than 10%, or 5%. In a preferred embodiment of the present disclosure, the amount of additive preferably is maintained below about 0.1%, namely about 0.08% (or 0.1 of an ounce of additive per gallon of fuel).

An embodiment according the present disclosure comprises a fuel additive formulation and a method of using same. The fuel additive formulation of the present disclosure preferably comprises at least one nitroparaffin selected from the group consisting of: nitropropane and nitromethane. When used as a motor fuel for automobiles, trucks, etc. and other internal combustion engines, the present disclosure preferably comprises from 0.01% to less than about 5% additive by weight, in gasoline. The amount of nitroparaffin in fuels of the present disclosure typically ranges from 0.064% to 7.6% by weight, and preferably below 0.5% by weight.

The fuel may be used in any kind of power unit, including, but not limited to, a boiler, a turbine, internal combustion engine, or any other type of appropriate application.

Applicant has conducted a series of experiments to test the performance of the additive according to embodiments of the present disclosure relative to various known formulations. These formulations are identified in the following examples.

EXAMPLES

Example 1

Diesel Engine Performance/Emission.

As an embodiment of the present disclosure, Applicant developed a novel #2 ULSD (Ultra Low Sulfur #2 Pump diesel) fuel additive that would reduce, or at least not increase emissions, while providing improved fuel economy. The testing was performed at Princeton Polymer Laboratories, Union, N.J. Applicant formulated several prototypes, which were screen tested for emissions and fuel economy against ULSD. Formula (F MAZ), (F MAZ/X) and (F MAZ/Y) were tested, where "X" refers to the formula containing 2,4-dinitrotoluene and "Y" refers to the formula containing azobisisobutyronitrile.

The performance of these prototypes was compared to a baseline of Shell pump ULSD (SULSD) and sub-baselines of SULSD treated with the known MAZ formulation comprising a third party proprietary ester formulation (Formulation L1699) (disclosed in U.S. Pat. Nos. 6,319,294 and 7,491,249, both assigned to the current Applicant, herein incorporated by reference in their entirety) and a 60/40 MAZ formulation comprising a third party proprietary ester formulation (Formulation L1699) and DTBP (600) at a ratio of 60:40 weight % (60 weight % MAZ and 40 weight % of a 600 ppm DTBP solution). The other formulations tested where F MAZ, F MAZ/600 [60/40] (60 weight % F MAZ:40 weight % of a 600 ppm solution of DTBP). The remaining formulations comprise F MAZ/X 70:30 F MAZ/X: 2,4 dinitrotoluene by weight %, F MAZ/X 60:40 F MAZ/X:2,4 dinitrotoluene by weight %, and F MAZ/Y 60:40 F MAZ/Y: azobisisobutyronitrile by weight %.

The baseline and fuel additive combinations were as follows:

A. Shell Ultra Low Sulfur #2 Pump diesel (SULSD) Baseline

B. SULSD+MAZ (L1699) Sub-baseline

C. SULSD+MAZ (L1699)/600 [60/40] Sub-baseline

D. SULSD+F MAZ

E. SULSD+F MAZ/600 [60/40]

F. SULSD+F MAZ/X [70/30]

G. SULSD+F MAZ/X [60/40]

H. SULSD+F MAZ/Y [60/40]

i. The SULSD baseline consisted of the average of two lots tested, ten emissions and ten fuel economy runs, done in two sets of five over two time periods. This is done to achieve a more accurate overall baseline profile due to the number of different lots of baseline required to run all the test blends and guarantee fresh fuel for the blends.

ii. Each test blend was run at four different dosages, 850 ppm, 1050 ppm, 1250 ppm and 1600 ppm, five repeat sets of emissions and fuel economy for each dosage.

The test protocol was the 01 Three Mode B-Type ISO 8178 Test Cycle. It is a constant speed international standard for non-road applications used for emissions certification. The DI Three Mode B consists of running a test engine at 100% load, 75% load, and 50% load for a given period of time at each load level during which emissions are collected and recorded at each load level. Fuel consumption is electronically recorded at each load change over. This is a weighted test.

The numerical total value for each emission is the sum of 30% of the 100% load reading, 50% of the 75% load reading, and 20% of the 50% load reading. Applicant displayed consolidated fuel consumption in grams/minute, so it is total grams consumed divided by total minutes run even though we show recordings by load for finer analysis.

The test engine was a Tier 4i qualified constant speed genset consisting of a Perkins 403D-07G 8 kW diesel engine fitted with a Mode283 CSL 1506 Marathon generator. An Enerac M700 Micro Emissions Monitoring System was used to measure Nitrogen Oxides (NOx) ppm, Carbon Monoxide (CO) ppm and Carbon Dioxide ($CO_2$) %. An FTIR was used to measure Total Hydrocarbons (THC) ppm. A separate weigh scale A&D GF3000 (SHS) Toploader Digital balance was electronically configured to measure fuel consumption, grams/minute for each engine load time segment.

TABLE 3

Test Results.

| Additive | Dosage, ppm | % Improvement Over Baseline THC | NOx | CO | $CO_2$ | Fuel |
|---|---|---|---|---|---|---|
| F MAZ | 850 | 21.2 | 7.5 | 5.1 | 11.1 | 3.3 |
| | 1050 | 6.5 | 1.5 | 6.9 | 11.1 | 3.5 |
| F MAZ 600 | 1050 | 2.9 | 5.0 | 3.6 | 6.7 | 3.7 |
| | 1250 | 5.4 | 0.9 | 6.5 | 6.5 | 3.3 |
| F MAZ/X [70/30] | 1050 | 6.8 | 8.5 | 3.7 | 6.5 | 4.0 |
| | 1250 | 14.2 | 6.8 | 0.2 | 7.4 | 3.9 |
| F MAZ/Y [60/40] | 1050 | 17.8 | 1.3 | 4.5 | 6.5 | 5.2 |

Table 3 shows those additive combinations with the best overall performance versus the untreated baseline fuel. F MAZ/Y [60/40], although deficient in NOx and CO, was included due to its superior fuel economy readings.

TABLE 4

Weighted results for each emission and fuel economy compared to the ULSD Shell #2.

| | Consolidated Results | | | | | | | | | |
|---|---|---|---|---|---|---|---|---|---|---|
| | THC ppm | | NOx ppm | | CO ppm | | CO2 % | | Fuel Cons. g/min | |
| | 5 Test Ave by Emission | | | | | | | | | |
| | Avg % Diff vs baseline | | Avg % Diff vs B Baseline | | Avg % Diff vs Baseline | | Avg % Diff vs Baseline | | Avg % Diff vs Baseline | |
| ULSD - Baseline | 12.92 | | 271.54 | | 71.41 | | 4.32 | | 27.19 | |
| MAZ | | | | | | | | | | |
| 850 ppm | 10.60 | 18.0% | 280.18 | −3.2% | 69.02 | 3.3% | 4.13 | 4.4% | 26.31 | 3.2% |
| 1050 ppm | 11.04 | 14.6% | 278.62 | −2.6% | 67.78 | 5.1% | 4.22 | 2.3% | 26.26 | 3.4% |
| 1250 ppm | 12.08 | 6.5% | 279.60 | −3.0% | 76.72 | −7.4% | 4.41 | −2.1% | 26.38 | 3.0% |
| 1600 ppm | 13.32 | −3.1% | 295.32 | −8.8% | 69.04 | 3.3% | 4.45 | −3.0% | 26.34 | 3.1% |
| MAZ (L1699) 600 (60/40) | | | | | | | | | | |
| 850 ppm | 14.22 | −10.1% | 259.10 | 4.6% | 65.80 | 7.9% | 4.13 | 4.4% | 26.24 | 3.5% |
| 1050 ppm | 14.52 | −12.4% | 299.26 | −10.2% | 63.36 | 11.3% | 4.05 | 6.3% | 26.37 | 3.0% |
| 1250 ppm | 13.36 | −3.4% | 328.51 | −21.0% | 67.60 | 5.3% | 4.43 | −2.5% | 26.35 | 3.1% |
| 1600 ppm | 12.60 | 2.5% | 299.70 | −10.4% | 66.58 | 6.8% | 4.34 | −0.5% | 26.24 | 3.5% |
| F MAZ | | | | | | | | | | |
| 850 ppm | 10.18 | 21.2% | 251.20 | 7.5% | 67.74 | 5.1% | 3.84 | 11.1% | 26.30 | 3.3% |
| 1050 ppm | 12.08 | 6.5% | 267.52 | 1.5% | 66.48 | 6.9% | 3.84 | 11.1% | 26.25 | 3.5% |
| 1250 ppm | 12.48 | 3.4% | 286.06 | −5.3% | 63.10 | 11.6% | 4.01 | 7.2% | 26.28 | 3.3% |
| 1600 ppm | 13.10 | −1.4% | 269.46 | 0.8% | 63.24 | 11.4% | 3.92 | 9.3% | 26.15 | 3.8% |
| F MAZ 600 (60/40] | | | | | | | | | | |
| 850 ppm | 11.54 | 10.7% | 335.16 | −23.4% | 69.50 | 2.7% | 4.11 | 4.9% | 26.44 | 2.8% |
| 1050 ppm | 12.54 | 2.9% | 257.86 | 5.0% | 68.84 | 3.6% | 4.03 | 6.7% | 26.18 | 3.7% |

TABLE 4-continued

| Weighted results for each emission and fuel economy compared to the ULSD Shell #2. | | | | | | | | | | |
|---|---|---|---|---|---|---|---|---|---|---|
| | Consolidated Results | | | | | | | | | |
| | THC ppm | | NOx ppm | | CO ppm | | CO2 % | | Fuel Cons. g/min | |
| | 5 Test Ave by Emission | | | | | | | | | |
| | Avg % Diff vs baseline | | Avg % Diff vs B Baseline | | Avg % Diff vs Baseline | | Avg % Diff vs Baseline | | Avg % Diff vs Baseline | |
| 1250 ppm | 12.22 | 5.4% | 269.07 | 0.9% | 66.80 | 6.5% | 4.04 | 6.5% | 26.28 | 3.3% |
| 1600 ppm | 8.84 | 31.6% | 288.16 | −6.1% | 56.62 | 20.7% | 3.91 | 9.5% | 26.19 | 3.7% |
| F MAZ/X [70/30] | | | | | | | | | | |
| 850 ppm | 11.84 | 8.4% | 267.54 | 1.5% | 71.84 | −0.6 | 4.06 | 6.0% | 26.31 | 3.2% |
| 1050 ppm | 12.04 | 6.8% | 248.36 | 8.5% | 68.78 | 3.7% | 4.04 | 6.5% | 26.10 | 4.0% |
| 1250 ppm | 11.08 | 14.2% | 253.12 | 6.8% | 71.28 | 0.2% | 4.00 | 7.4% | 26.13 | 3.6% |
| 1600 ppm | 11.44 | | | | | | | | | |
| F MAZ/X [60/40] | | | | | | | | | | |
| 850 ppm | 11.52 | 10.8% | 295.88 | −9.0% | 89.70 | −25.6% | 3.98 | 7.9% | 26.50 | 2.5% |
| 1050 ppm | 11.08 | 14.2% | 292.12 | −7.6% | 68.52 | 4.0% | 3.95 | 8.6% | 26.38 | 3.0% |
| 1250 ppm | 11.76 | 9.0% | 284.28 | −4.7% | 72.26 | −1.2% | 4.02 | 6.9% | 26.37 | 3.0% |
| 1600 ppm | 11.58 | 10.4% | 280.28 | −3.2% | 73.58 | −3.0% | 4.00 | 7.4% | 26.29 | 3.3% |
| F MAZ/Y [60/40] | | | | | | | | | | |
| 850 ppm | 10.84 | 16.1% | 279.42 | −2.9% | 78.38 | −9.8% | 4.00 | 7.4% | 25.96 | 4.5% |
| 1050 ppm | 10.62 | 17.8% | 275.16 | −1.3% | 74.60 | −4.5% | 4.04 | 6.5% | 25.78 | 5.2% |
| 1250 ppm | 9.30 | 28.0% | 268.64 | 1.1% | 73.38 | −2.8% | 3.91 | 9.5% | 26.10 | 4.0% |
| 1600 ppm | 10.24 | 20.7% | 274.78 | −1.2% | 79.32 | −11.1% | 4.08 | 5.6% | 26.13 | 3.9% |

Table 4 shows the weighted results for each emission and fuel economy, by additive and by dosage, compared to the ULSD Shell #2 pump diesel baseline.

TABLE 5

| Pure emissions readings by individual engine load. | | | | | | | | | | | | | | | |
|---|---|---|---|---|---|---|---|---|---|---|---|---|---|---|---|
| | Consolida-ted Results | | | | | | | | | | | | | | |
| | THC ppm Load % | | | NOx ppm Load % | | | CO ppm Load % | | | $CO_2$% Load % | | | Fuel Consumption g Load % | | |
| | 5 Test Avg by Mode | | | | | | | | | | | | | | |
| | 100 (0.3) | 75 (0.5) | 50 (0.2) | 100 (0.3) | 75 (0.5) | 50 (0.2) | 100 (0.3) | 75 (0.5) | 50 (0.2) | 100 (0.3) | 75 (0.5) | 50 (0.2) | 100 (0.3) | 75 (0.51 | 50 (0.1) |
| UL5D - Baseline MAZ (L1699) | 12.6 | 13.0 | 13.2 | 292.2 | 273.8 | 235.0 | 71.6 | 68.7 | 77.9 | 5.1 | 4.3 | 3.3 | 927.86 | 1370.16 | 420.73 |
| 850 ppm | 10.8 | 10.4 | 10.8 | 298.4 | 284.8 | 241.3 | 71.4 | 66.0 | 73.0 | 5.0 | 4.3 | 3.3 | 909.24 | 1311.54 | 410.08 |
| 1050 ppm | 12.6 | 9.8 | 11.8 | 301.2 | 281.8 | 236.8 | 68.8 | 63.4 | 77.2 | 4.9 | 4.2 | 3.2 | 908.70 | 1307.84 | 409.83 |
| 1250 ppm | 12.2 | 11.8 | 12.6 | 291.2 | 276.4 | 270.2 | 79.0 | 75.0 | 76.6 | 5.2 | 4.3 | 3.5 | 914.91 | 1314.24 | 409.14 |
| 1600 pmm MAZ (L1699) 600 [60/40] | 12.6 | 13.8 | 13.2 | 319.0 | 296.9 | 255.8 | 64.0 | 66.4 | 83.2 | 5.1 | 4.5 | 3.3 | 910.39 | 1309.80 | 414.06 |
| 850 ppm | 13.6 | 14.6 | 14.2 | 248.3 | 284.4 | 212.1 | 61.6 | 64.0 | 76.6 | 4.8 | 4.1 | 3.2 | 906.52 | 1307.28 | 410.06 |
| 1050 ppm | 14.6 | 14.6 | 14.2 | 314.0 | 301.0 | 272.8 | 60.8 | 61.6 | 71.6 | 5.1 | 3.9 | 3.0 | 908.89 | 1317.18 | 410.80 |
| 1250 ppm | 13.4 | 13.4 | 13.2 | 342.0 | 329.5 | 305.8 | 66.6 | 67.8 | 68.6 | 5.2 | 4.4 | 3.4 | 909.21 | 1313.38 | 412.77 |
| 1600 pmm F MAZ | 13.0 | 12.6 | 12.0 | 313.2 | 305.0 | 266.2 | 61.6 | 65.4 | 77.0 | 5.1 | 4.3 | 3.3 | 905.12 | 1307.36 | 411.23 |
| 850 ppm | 11.0 | 10.0 | 9.40 | 277.8 | 260.6 | 187.8 | 64.8 | 67.4 | 73.0 | 4.8 | 3.6 | 3.0 | 907.27 | 1314.21 | 408.72 |
| 1050 ppm | 11.6 | 12.4 | 12.0 | 283.6 | 270.0 | 237.2 | 63.6 | 66.4 | 71.0 | 4.5 | 3.8 | 3.0 | 904.24 | 1309.77 | 410.79 |
| 1250 ppm | 12.2 | 12.6 | 12.6 | 312.4 | 285.0 | 249.2 | 26.0 | 60.6 | 80.0 | 4.8 | 3.9 | 3.1 | 907.77 | 1313.70 | 406.10 |
| 1600 pmm | 12.6 | 13.6 | 13.2 | 295.1 | 269.5 | 230.7 | 61.8 | 60.6 | 72.0 | 4.9 | 3.9 | 2.5 | 903.53 | 1305.23 | 406.44 |

TABLE 5-continued

| Pure emissions readings by individual engine load. | | | | | | | | | | | | | | | |
|---|---|---|---|---|---|---|---|---|---|---|---|---|---|---|---|
| | Consolida-ted Results | | | | | | | | | | | | | | |
| | THC ppm Load % | | | NOx ppm Load % | | | CO ppm Load % | | | $CO_2$% Load % | | | Fuel Consumption g Load % | | |
| | 5 Test Avg by Mode | | | | | | | | | | | | | | |
| | 100 (0.3) | 75 (0.5) | 50 (0.2) | 100 (0.3) | 75 (0.5) | 50 (0.2) | 100 (0.3) | 75 (0.5) | 50 (0.2) | 100 (0.3) | 75 (0.5) | 50 (0.2) | 100 (0.3) | 75 (0.51 | 50 (0.1) |
| F MAZ 600 [60/40] | | | | | | | | | | | | | | | |
| 850 ppm | 11.6 | 11.4 | 11.8 | 357.4 | 330.2 | 314.2 | 70.0 | 68.2 | 72.0 | 4.9 | 4.1 | 3.1 | 920.00 | 1310.42 | 413.53 |
| 1050 ppm | 12.4 | 12.6 | 12.6 | 285.0 | 267.2 | 193.8 | 68.0 | 65.2 | 79.2 | 4.7 | 4.0 | 3.1 | 904.42 | 1299.65 | 413.54 |
| 1250 ppm | 11.8 | 12.4 | 12.4 | 286.2 | 271.2 | 238.1 | 62.4 | 64.8 | 78.4 | 4.9 | 3.9 | 3.0 | 909.55 | 1305.83 | 412.94 |
| 1600 pmm | 8.8 | 9.0 | 8.8 | 308.2 | 292.4 | 251.9 | 52.2 | 55.2 | 66.8 | 4.7 | 3.8 | 3.0 | 905.74 | 1301.87 | 411.49 |
| F MAZ/X [70/30 ] | | | | | | | | | | | | | | | |
| 850 ppm | 11.6 | 12.0 | 11.8 | 276.8 | 267.8 | 253.0 | 68.4 | 71.6 | 77.6 | 4.8 | 4.0 | 3.1 | 906.60 | 1307.86 | 416.51 |
| 1050 ppm | 11.8 | 12.2 | 12.0 | 269.0 | 245.4 | 224.8 | 65.0 | 72.4 | 65.4 | 4.9 | 3.9 | 3.0 | 903.09 | 1291.66 | 415.38 |
| 1250 ppm | 10.6 | 11.4 | 11.0 | 274.4 | 249.2 | 231.0 | 64.0 | 72.4 | 79.4 | 4.9 | 3.9 | 3.0 | 901.50 | 1300.54 | 411.00 |
| 1600 pmm | 11.8 | 11.4 | 11.0 | 309.8 | 298.0 | 278.0 | 64.0 | 58.6 | 67.8 | 4.9 | 3.7 | 2.9 | 906.44 | 1308.24 | 407.57 |
| F MAZ/X [60/40] | | | | | | | | | | | | | | | |
| 850 ppm | 11.6 | 11.6 | 11.2 | 315.8 | 295.0 | 268.2 | 90.6 | 90.0 | 87.6 | 4.9 | 3.8 | 3.1 | 912.61 | 1319.52 | 417.60 |
| 1050 ppm | 11.4 | 11.0 | 10.8 | 310.0 | 291.2 | 267.6 | 66.4 | 67.6 | 74.0 | 4.7 | 3.9 | 3.1 | 906.35 | 1312.00 | 419.20 |
| 1250 ppm | 12.0 | 11.6 | 11.8 | 309.8 | 283.8 | 247.2 | 70.0 | 70.2 | 80.8 | 4.9 | 3.9 | 3.1 | 908.67 | 1310.44 | 418.15 |
| 1600 pmm | 11.6 | 11.4 | 12.0 | 291.8 | 278.6 | 267.2 | 66.8 | 75.0 | 80.2 | 4.9 | 3.8 | 3.1 | 904.22 | 1310.89 | 413.40 |
| F MAZ/Y [60/40] | | | | | | | | | | | | | | | |
| 850 ppm | 10.6 | 11.0 | 10.8 | 286.6 | 280.8 | 265.2 | 78.4 | 78.6 | 77.8 | 4.8 | 3.9 | 3.1 | 887.94 | 1296.30 | 411.56 |
| 1050 ppm | 11.0 | 9.4 | 10.6 | 294.2 | 273.4 | 251.0 | 73.6 | 74.0 | 77.6 | 4.9 | 3.9 | 3.1 | 887.19 | 1282.70 | 408.32 |
| 1250 ppm | 9.0 | 9.6 | 9.0 | 288.6 | 267.4 | 241.8 | 75.4 | 72.4 | 73.4 | 4.6 | 3.8 | 3.0 | 896.30 | 1301.89 | 411.50 |
| 1600 pmm | 10.2 | 10.2 | 10.4 | 291.6 | 272.2 | 256.0 | 79.4 | 80.6 | 76.0 | 4.7 | 4.0 | 3.3 | 898.21 | 1300.49 | 414.30 |

Table 5 shows pure emissions readings by individual engine load and total fuel consumed at each load for more in depth analysis at each setting. This data may be useful in choosing an additive for a specific application. It is important to note that 100% load ran for 30 minutes, 75% load for 50 minutes, and 50% load for 20 minutes, for a total time of 100 minutes per test cycle—not to be confused with the required load weighting calculations.

As can be seen from Table 5, the F-MAZ/X formulation provides a good combination of mileage performance and emissions reduction in diesel fuel. The F-MAZ/Y formulation provided better mileage performance, but emissions reduction was not as good as in F-MAZ/X.

Example 2

Diesel Emission Reduction (Particulate Matter Reduction).

Study on Engine bench-test of efficient fuel additives in gasoline. The "MAZ 1000" additive comprises F MAZ at a final concentration of 1000 ppm. It is shown that using the F MAZ formulation in gasoline reduces particulate matter (PM) in gasoline emissions. Engine parameters are shown in Table 6.

TABLE 6

| | |
|---|---|
| Displacement | 5.9 liters |
| Cylinders | L6 |

TABLE 6-continued

| | |
|---|---|
| Emission Standard | China V/Euro V |
| Maximum output power | 132 kW/180 Ps |
| Rated speed | 2,500 rpm |
| Maximum torque | 700 Nm |
| Bore × Stroke | 102 × 120 mm |

Test equipment comprised: AVL Electric Dynamometer (power range 500 kW; AMA i60/SESAM i60 (conventional/unconventional emission analysis); AVL439 (smoke detection); AVL SPC472/489 (emission detection PM/PN); AVL ACS Intake Air Conditioner 735 Transient Fuel Consumption Meter; and an AVL 553 Cooling water/Inter-cooling Control.

The reference standard is GB17691-2005 "Limits and measurement methods for exhaust pollutants from compression ignition and gas fueled positive ignition engines of vehicles (III, IV, V)" which is incorporated herein in its entirety.

The test fuel was prepared as shown in Table 7.

TABLE 7

| Sample | Category | Component 1 | Component 2 | Quality Ratio |
|---|---|---|---|---|
| MAZ | Benchmark Diesel | China-V Diesel | N/A | N/A |
| MAZ 1000 | Benchmark Diesel plus fuel additive | China-V Diesel | Fuel Additive | Referring Test Scheme |

The tests were carried out comparing the benchmark diesel and the benchmark diesel with additive respectively followed by analysis of the results. The test scheme is shown in Table 8.

TABLE 8

| Emission Index | Test Category | Engine Emission (with SCR) | Raw Emission (without SCR) |
|---|---|---|---|
| PM | ESC Cycle<br>ETC Cycle | Yes | No |
| 439 Smoke | ESC Cycle<br>ETC Cycle | Yes | No |
| NOx | Typical operating conditions contrast | No | Yes |

In Table 8, "ESC" is European Stationary Cycle, and "ETC" is European Transient Cycle. 439 Smoke or 439 Smoke Emission is a measurement of exhaust gas opacity measured by an absorption opacimeter, in this case an AVL Opacimeter 439. The adsorption opacimeter makes use of phenomena relating to the absorption of visible radiation (light) passing through the gas. Exhaust gas opacity is a result of the presence of solid particles (mostly soot—black smoke), hydrocarbons (blue smoke) and water vapor (white smoke). At a soot content of 100-300 mg/m3 the exhaust gas opacity is noticeable. Black smoke appears at concentrations of approx. 500 mg/m3. An increase in exhaust gas opacity is usually accompanied by an increase in the emission of other harmful exhaust gas components ($CO_2$, CO, HC, NOx).

FIG. 1 represents a schematic of the engine set up used.

Figure 2:
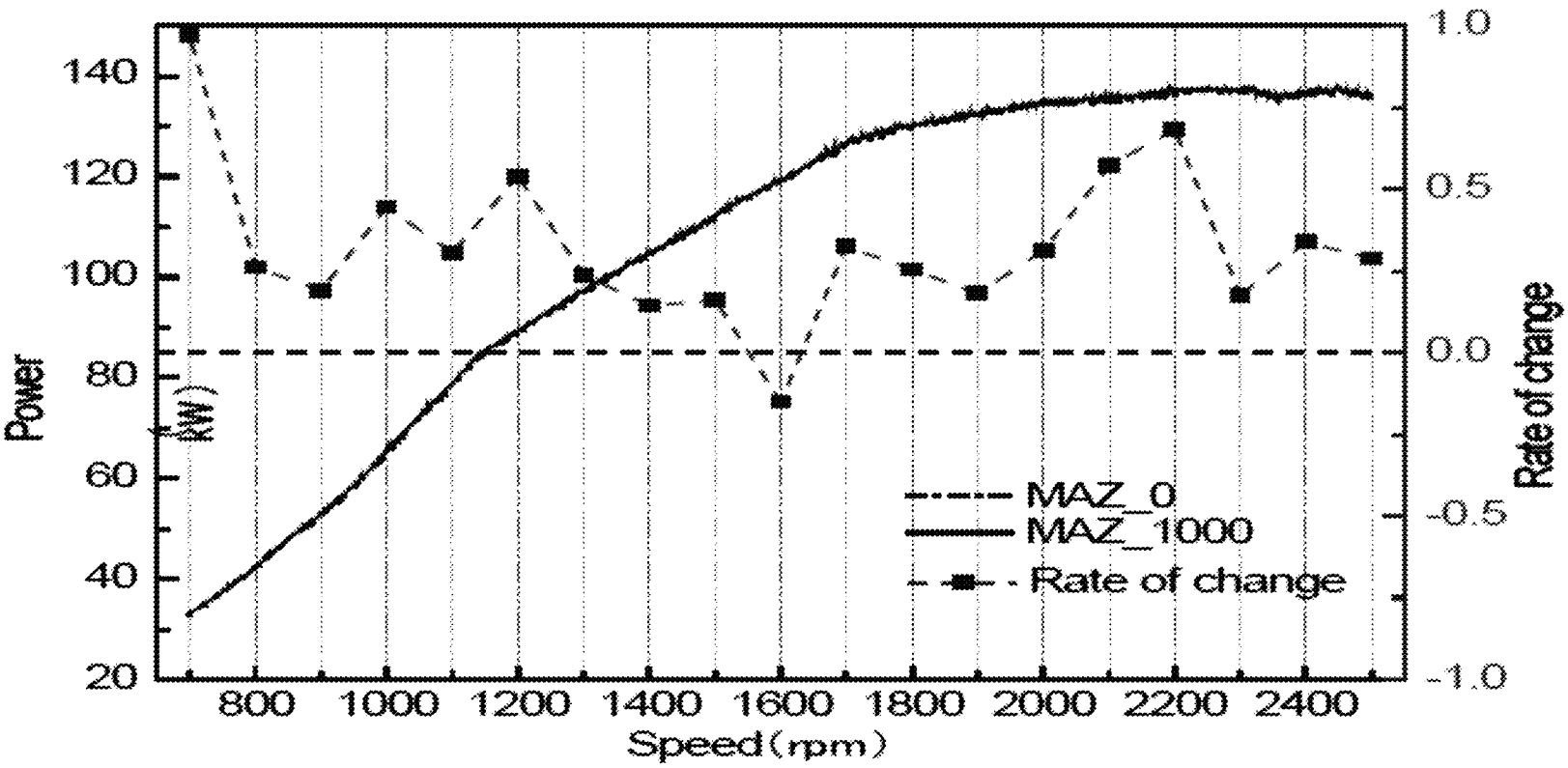
FIG. 2 illustrates the power analysis of the tested fuels with and without the MAZ 1000 additive according to an embodiment of the present invention.

FIG. 2 illustrates the power analysis of the tested fuels with and without the MAZ 1000 additive according to an embodiment of the present invention. It is shown that after adding the MAZ 1000 additive, engine power increases and the torque increases under the same conditions.

Figure 3:
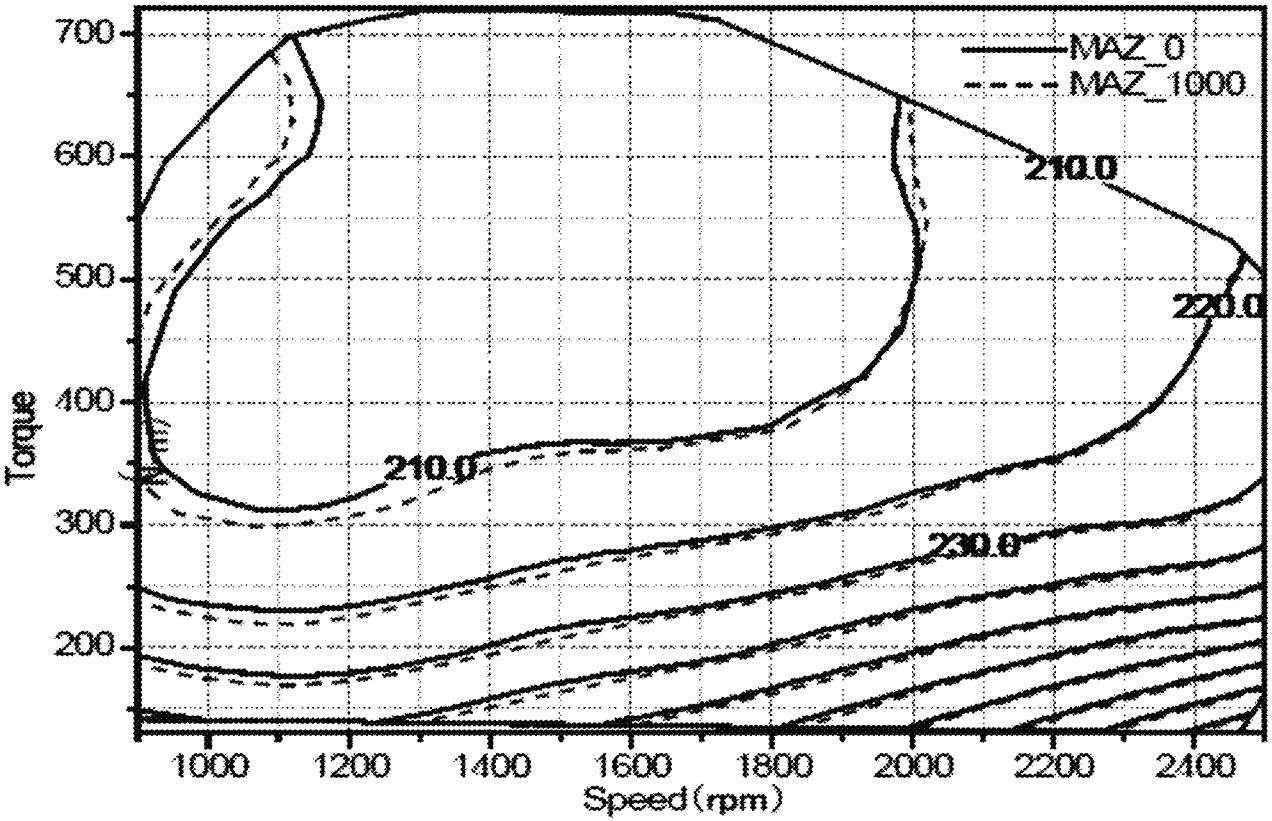
FIG. 3 illustrates the fuel economy analysis of the tested fuels with and without the MAZ 1000 additive according to an embodiment of the present invention.

FIG. 3 illustrates the fuel economy analysis of the tested fuels with and without the MAZ 1000 additive according to an embodiment of the present invention. It is shown that the engine fuel economy zone expands after adding the MAZ 1000 additive.

Figure 4:
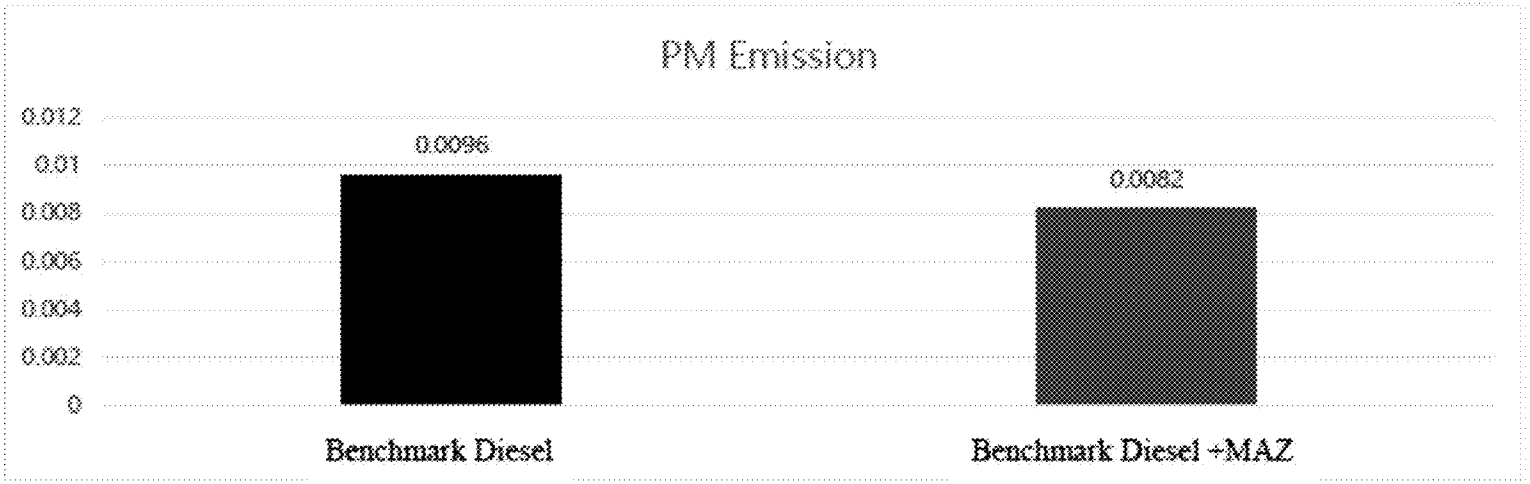
FIG. 4 illustrates the emission characteristics, ESC cycle, PM emission.

FIG. 4 illustrates the emission characteristics, ESC cycle, and particulate matter (PM) emission. The data show that as for ESC, PM emission decreases from 0.0096 g/kWh to 0.0082 g/kWh, a decrease of 14.58%, after adding the MAZ 1000 additive.

Figure 5:
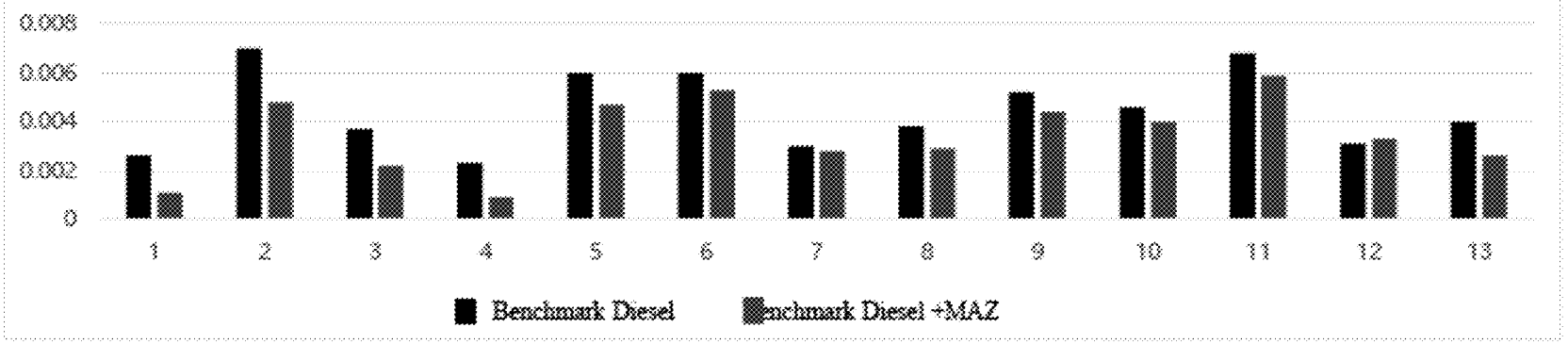
FIG. 5 illustrates the emission characteristics, ESC cycle, 439 smoke emission.

FIG. 5 illustrates the emission characteristics, ESC, 439 smoke emission. The data show that as for ESC, 439 Smoke decreases significantly under most operating conditions, an average of 24.96%, after adding the MAZ 1000 additive.

FIG. 6 illustrates the emission characteristics, ESC, and other pollutants emission. The data show that as for ESC, NOx (nitrogen oxide), $CO_2$ (carbon dioxide), CO (carbon monoxide), HC (hydrocarbon) and the like are effectively controlled after adding the MAZ 1000 additive.

Figure 7:
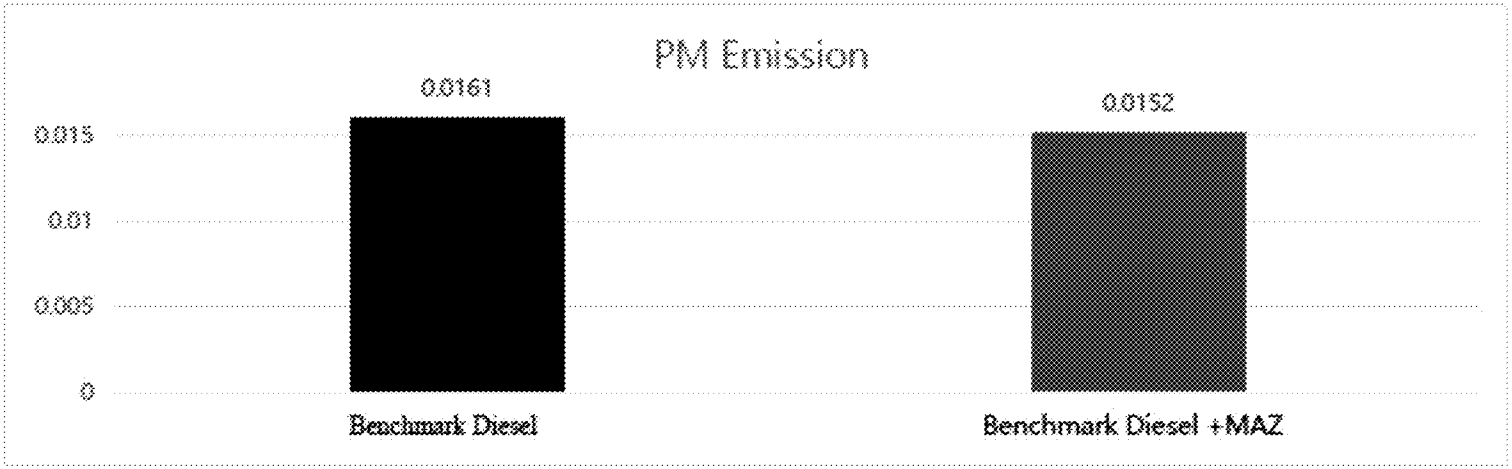
FIG. 7 illustrates the emission characteristics, ETC cycle, PM emission.

FIG. 7 illustrates the emission characteristics, ETC, and PM emission. The data show that as for ETC, PM emission decreases from 0.0161 g/kWh to 0.0152 g/kWh, a decrease of 5.59%, after adding the MAZ 1000 additive.

Figure 8:
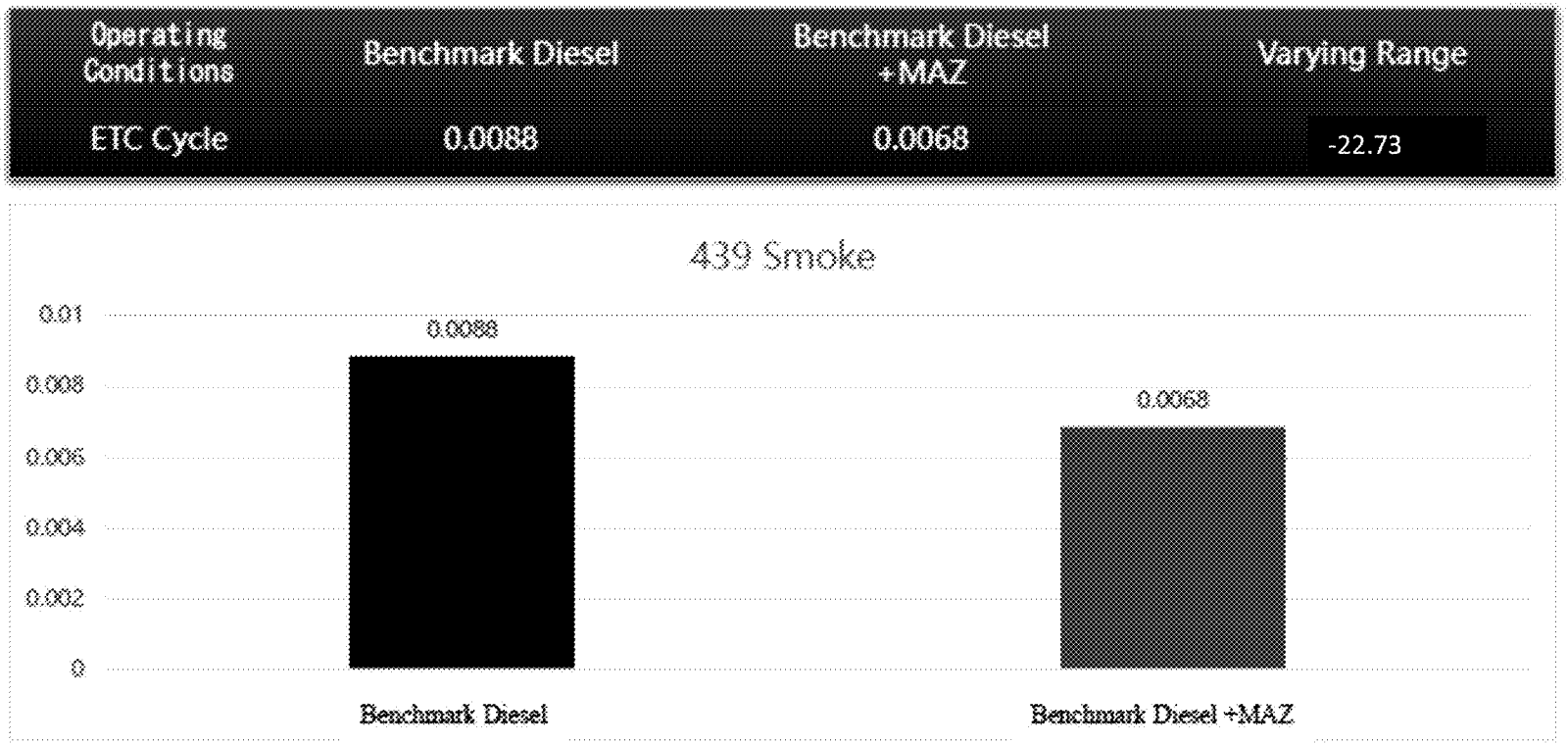
FIG. 8 illustrates the emission characteristics, ETC cycle, 439 smoke emission.

FIG. 8 illustrates the emission characteristics, ETC, and 439 emission. The data show that as for ETC, 439 Smoke has dropped by 22.73% after adding the MAZ 1000 additive.

FIG. 9 illustrates the emission characteristics, ETC, and other pollutants emission. The data show that as for ETC, $CO_2$, CO, THC (total hydrocarbon), and NOx emissions are effectively controlled after adding the MAZ 1000 additive.

Figure 10:
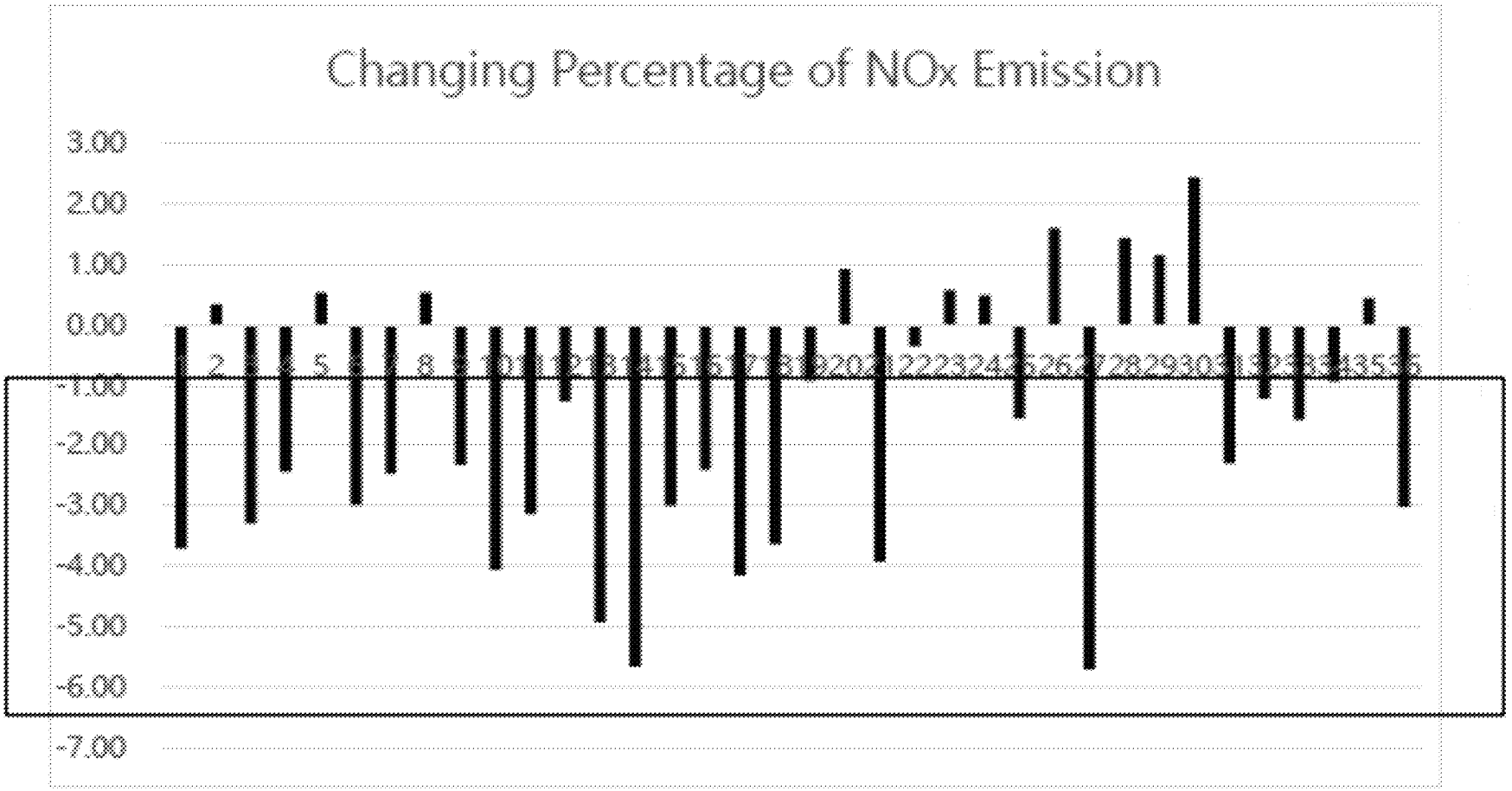
FIG. 10 illustrates the emission characteristics of NOx under typical operating conditions.

FIG. 10 illustrates the emission characteristics of NOx under typical operating conditions. The data show that NOx emission decreases significantly under most operating conditions after adding the MAZ 1000 additive and the max decreasing amplitude is 5.70%.

As demonstrated in Example 2:

After adding the MAZ 1000 additive engine power is enhanced, thermal efficiency increases, and fuel economy improves.

As for ESC, after adding the MAZ 1000 additive, PM emission decreases from 0.0096 g/kWh to 0.0082 g/kWh, a decrease of 14.58% and 439 Smoke decreases significantly under most operating conditions, an average of 24.96%.

As for ETC, after adding the MAZ 1000 additive, PM emission decreases from 0.0161 g/kWh to 0.0152 g/kWh, a decrease of 5.59%, and 439 Smoke has dropped by 22.73%.

As for ESC and ETC, NOx, $CO_2$, CO, and HC are effectively controlled after adding the MAZ 1000 additive.

As for the original engine typical operating conditions, NOx emission decreases significantly under most operating conditions after adding the MAZ 1000 additive and the max decreasing amplitude is 5.70%.

The dramatic reductions in PM and NOx emissions significantly alleviate diesel particulate filter (DPF) regeneration pressure and urea-injection volume effectively, prolong the after treatment system durability, and thereby reducing the customer-use cost.

Figure 11:
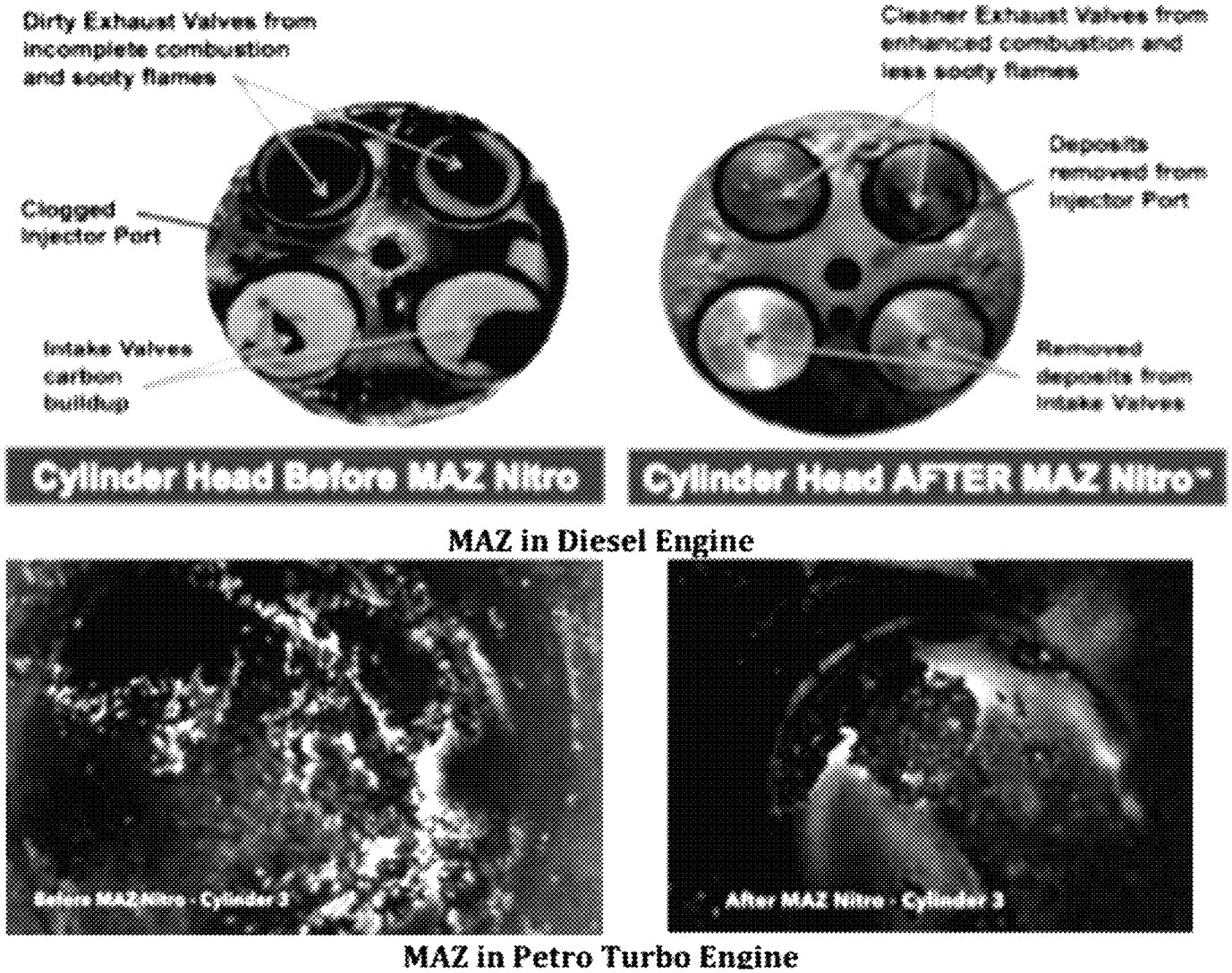
FIG. 11 depicts the photographs illustrating the condition of the cylinder heads before and after the use of the F MAZ (MAZ Nitro) embodiment of the present disclosure.

FIG. 11 depicts photographs illustrating the condition of engine cylinder heads before and after the use of the F MAZ embodiment of the present disclosure. It can be seen in the cylinder head before treatment with the additive the exhaust valves are dirty due to incomplete combustion and sooty flames, clogged injector ports, and carbon buildup on the intake valves.

As can be seen post treatment with the F MAZ additive, the exhaust valves are "cleaner" due to enhanced combustion and a decrease in sooty flames, the degree of carbon deposits are reduced in the injector ports, and the degree of carbon deposits are reduced from the intake valves.

It will be apparent to those skilled in the art that various modifications and variations can be made in the construction and configuration of the present disclosure without departing from the scope or spirit of the disclosure. Thus, it is intended that the present disclosure cover the modifications and variations of the disclosure provided they come within the scope of the appended claims and their equivalents.

A preferred embodiment of the present disclosure is a fuel additive for motor fuels for internal combustion engines, comprising nitroparaffin, a lubricant, and an aromatic hydrocarbon. Applicant has developed a novel method of creating a stable mixture of nitroparaffins in gasoline and/or diesel fuel, namely by the introduction of a novel lubricant. Applicant has discovered that low concentrations of fuel additives reduce emissions. Toxicity has been reduced by modifying the lubricant and by reducing the concentration of additive in the fuel, while reducing emissions.

It will be apparent to those skilled in the art that various modifications and variations can be made in the construction and configuration of the present disclosure without departing from the scope or spirit of the disclosure. Thus, it is intended that the present disclosure cover the modifications and variations of the disclosure provided they come within the scope of the appended claims and their equivalents.

We claim:

1. An additive formulation for a fuel comprising:

about 40 to about 65 weight percent nitropropane;

about 10 to about 30 weight percent nitromethane;

about 0.5 to about 5 weight percent lubricant, wherein the lubricant is a $C_5$-$C_{10}$ fatty acid ester with pentaerythritol and dipentaerythritol;

about 10 to about 40 weight percent toluene;

wherein the additive is substantially free of nitroethane.

2. A fuel comprising the additive of claim 1.

3. The formulation of claim 1, wherein the lubricant comprises about 75 wt. % to about 80 wt. % of the $C_5$-$C_{10}$ fatty acid ester with pentaerythritol.

4. The formulation of claim 1, wherein the lubricant comprises about 19 wt. % to about 24 wt. % of the $C_5$-$C_{10}$ fatty acid ester with dipentaerythritol.

5. The formulation of claim 1, wherein combustion in an internal combustion engine of a fuel containing the additive results in reduced emissions relative to the combustion of a fuel not containing the additive, and wherein the reduced emissions are comprised of at least one of total hydrocarbons, non-methane hydrocarbons, carbon monoxide, and NON.

6. The formulation of claim 1, wherein combustion in an internal combustion engine of a fuel containing the additive results in a reduction in particulate matter emissions relative to the combustion of a fuel not containing the additive.

7. The formulation of claim 6, wherein combustion in an internal combustion engine of a fuel containing the additive results in enhanced engine performance relative to the combustion of a fuel not containing the additive.

* * * * *